US007041045B2

(12) United States Patent
Thiemann

(10) Patent No.: US 7,041,045 B2
(45) Date of Patent: May 9, 2006

(54) SKIMMER DEVICE FOR DISCHARGING LIQUID FROM A CENTRIFUGAL DRUM

(75) Inventor: Ludger Thiemann, Oelde (DE)

(73) Assignee: Westfalia Separator AG, Oelde (DE)

( * ) Notice: Subject to any disclaimer, the term of this patent is extended or adjusted under 35 U.S.C. 154(b) by 91 days.

(21) Appl. No.: 10/488,659

(22) PCT Filed: Sep. 2, 2002

(86) PCT No.: PCT/DE02/03219

§ 371 (c)(1),
(2), (4) Date: Apr. 26, 2004

(87) PCT Pub. No.: WO03/024606

PCT Pub. Date: Mar. 27, 2003

(65) Prior Publication Data

US 2004/0242395 A1 Dec. 2, 2004

(30) Foreign Application Priority Data

Sep. 5, 2001 (DE) ..... 101 43 405

(51) Int. Cl.
*B04B 11/08* (2006.01)

(52) U.S. Cl. ..... 494/56

(58) Field of Classification Search ..... 494/56–59, 494/68–73

See application file for complete search history.

(56) References Cited

U.S. PATENT DOCUMENTS 1,256,810 A * 2/1918 Leitch et al. ..... 494/37
2,125,453 A * 8/1938 Hans ..... 494/43
2,171,136 A * 8/1939 Nore ..... 494/64
2,622,796 A * 12/1952 Steinacker et al. ..... 494/10
2,622,797 A * 12/1952 Hemfort ..... 494/37
2,667,338 A * 1/1954 Hemfort ..... 366/173.1
3,317,126 A * 5/1967 Little et al. ..... 494/27
4,383,639 A * 5/1983 Hovstadius ..... 494/43
4,406,652 A * 9/1983 Nielsen ..... 494/56
4,417,885 A * 11/1983 Kohlstette et al. ..... 494/23
4,615,690 A * 10/1986 Ecker ..... 494/56
4,718,886 A * 1/1988 Mackel ..... 494/58
4,718,887 A * 1/1988 Gunn ..... 494/58
5,024,648 A * 6/1991 Inge et al. ..... 494/56

(Continued)

FOREIGN PATENT DOCUMENTS

DE 696796 6/1936

(Continued)

*Primary Examiner*—Charles E. Cooley
(74) *Attorney, Agent, or Firm*—Milde & Hoffberg, LLP

(57) ABSTRACT

A skimmer device (100) for discharging liquid from a centrifuge drum (10) comprising a vertically arranged skimmer disk pipe (20) and a skimmer disk (30) which is arranged inside the centrifuge drum and provided with at least one inlet duct. The inlet duct extends from the periphery (31) of the skimmer disk (30) and leads into at least one shaft duct (22) which extends at least partially along the skimmer disk pipe. The inlet duct and the shaft duct (22) form a discharge duct which has at least one throttle point (25, 27) where the cross-sectional area of the discharge is reduced. The inlet duct is divided by at least one duct division element (33.1, 33.2) into at least two partial inlet ducts (32.1 . . . 32.3) which are arranged on top of each other and which lead into the shaft duct (22). Each partial inlet duct (32.1 . . . 32.3) is provided with at least one partial inlet duct throttle element (34.1 . . . 34.3) at said throttle point.

10 Claims, 4 Drawing Sheets

U.S. PATENT DOCUMENTS

| | | | | | |
|---|---|---|---|---|---|
| 5,147,280 | A | * | 9/1992 | Carlsson et al. | 494/56 |
| 5,160,311 | A | * | 11/1992 | Inge et al. | 494/56 |
| 5,167,609 | A | * | 12/1992 | Graw et al. | 494/23 |
| 5,171,205 | A | * | 12/1992 | Monkenbusch | 494/10 |
| 5,405,307 | A | * | 4/1995 | Borgstrom et al. | 494/57 |
| 5,518,494 | A | * | 5/1996 | Borgstrom et al. | 494/56 |
| 5,599,271 | A | * | 2/1997 | Eiken | 494/37 |
| 5,709,643 | A | * | 1/1998 | Borgstrom et al. | 494/56 |
| 5,779,619 | A | * | 7/1998 | Borgstrom et al. | 494/56 |
| 5,788,622 | A | * | 8/1998 | Borgstrom et al. | 494/57 |
| 5,885,202 | A | * | 3/1999 | Ostkamp | 494/25 |
| 6,015,375 | A | * | 1/2000 | Moss | 494/27 |
| 6,033,356 | A | * | 3/2000 | Mackel et al. | 494/70 |
| 6,176,820 | B1 | * | 1/2001 | Westerberg | 494/63 |
| 6,623,417 | B1 | * | 9/2003 | Zettier | 494/57 |
| 6,976,948 | B1 | * | 12/2005 | Hamblad | 494/57 |
| 2004/0242395 | A1 | * | 12/2004 | Thiemann | 494/56 |
| 2005/0003946 | A1 | * | 1/2005 | Thiemann et al. | 494/56 |

FOREIGN PATENT DOCUMENTS

| | | | | |
|---|---|---|---|---|
| DE | 1657658 | | | 3/1971 |
| DE | 2147124 | | | 3/1973 |
| DE | 36 01 814 | A1 | | 7/1987 |
| DE | 37 31 229 | A1 | | 3/1989 |
| DE | 3731229 | A1 | * | 3/1989 |
| DE | 3936150 | A1 | * | 6/1990 |
| DE | 4106874 | A1 | * | 6/1992 |
| DE | 4126565 | C1 | * | 11/1992 |
| DE | 4132044 | C1 | * | 11/1992 |
| DE | 19540031 | C1 | * | 3/1997 |
| EP | 1038584 | A1 | * | 9/2000 |
| EP | 1457263 | A2 | * | 9/2005 |
| WO | 94/06565 | | * | 3/1994 |
| WO | 94/08723 | | * | 4/1994 |
| WO | 95/29013 | | * | 11/1995 |
| WO | 96/21510 | | * | 7/1996 |
| WO | 97/27946 | | * | 8/1997 |
| WO | 98/05431 | | * | 2/1998 |
| WO | 00/41813 | | * | 7/2000 |
| WO | 03/024606 | | * | 3/2005 |

* cited by examiner

SKIMMER DEVICE FOR DISCHARGING LIQUID FROM A CENTRIFUGAL DRUM

BACKGROUND OF THE INVENTION

The invention relates to a skimmer device for discharging liquid from a centrifuge drum, comprising a vertically arranged skimmer disc pipe and a skimmer disc, which is arranged inside the centrifuge drum and is provided with at least one inlet duct that extends from the periphery of the skimmer disc and empties into at least one shaft duct, which extends at least partially along the skimmer disc pipe, whereby the inlet duct and the shaft duct form a discharge duct, which exhibits at least one throttle point where the cross-sectional area of the discharge duct is reduced.

The volume stream to be discharged from a centrifuge drum through the skimmer device is influenced significantly by the size of the cross-sectional area of the discharge ducts. To increase the cross-sectional areas, several inlet ducts may be provided at the skimmer disc, where said inlet ducts are offset from one another by a certain angle. However, due to the limited area of the skimmer device, the number of radially arranged inlet ducts that are separated from one another by bars cannot be increased arbitrarily.

Alternatively, or in addition, increasing the duct height of each individual inlet duct can be provided in order to increase the maximum volume stream that can be achieved with the skimmer device. However, since centrifuges are often operated with alternating and very different inlet and discharge loads, pressure and volume fluctuations occur, which excite vibrations of the heads of liquid in the ducts, in particular, when the centrifuge is operated at small loads. The vibrations lead to undesirable noise levels and may lead to cavitations in the ducts. In addition, the liquid vibrations may be transferred to the centrifuge drum and in this manner to the centrifuge as a whole.

A centrifuge of this kind is known from DE-OS 37 31 229. Here, several inlet ducts are arranged radially offset to one another in order to increase the discharge load of the skimmer device. A throttle point is located in the shaft duct of the skimmer disk pipe behind the mouths of the inlet ducts of the skimmer device, when viewed in the flow direction. The throttle point results in a strong dampening of the inlet ducts and in this manner prevents the disadvantageous vibrations of the heads of liquid. However, the maximum discharge volume stream that can be achieved with the skimmer device is reduced through the necessary strong throttling.

From the patent DE 696 796, it is known to provide two ring-shaped shaft ducts that are arranged concentric to one another and that are guided in the skimmer disk to its periphery in ducts that are arranged on top of each other. One of the ducts is used as a discharge duct for the liquid drawn from the centrifuge drum and the other for supplying carbonic acid to the centrifuge drum. A utilization of this additional duct, which is provided for the gas supply, for withdrawing liquid is not disclosed. In addition, vibration problems occur with these two ducts as well. Furthermore, the design of concentrically arranged ducts that are nested in one another is elaborate in both design and manufacture.

SUMMARY OF THE INVENTION

It is, therefore, an objective of the present invention to improve a skimmer device of the type described above such that the maximum volume stream that can be withdrawn from the centrifuge drum is increased, while at the same time liquid vibrations are avoided even during operation at small discharge rates.

This objective, as well as other objectives which will become apparent from the discussion that follows, are achieved, in accordance with the present invention, by dividing the inlet duct into at least two partial inlet ducts located one above the other by means of horizontally arranged duct separating elements and by providing each partial inlet duct with at least one throttle element in the inlet duct at a throttle point therein.

Surprisingly, it has been shown that the withdrawal rate of the skimmer device can be increased by splitting an inlet duct with a large duct height into several partial inlet ducts with smaller duct heights that are arranged vertically above one another. Through a reduced duct height for each individual partial inlet duct, liquid vibrations are avoided to a large degree. At the same time, with the sum of the cross-sectional areas of all partial inlet ducts, a cross-sectional area for withdrawing liquid from the centrifuge is provided at the skimmer disk with a size that, according to the invention, allows the design of skimmer devices for a withdrawal rate of greater than 100 $m^3/h$ without the occurrence of liquid vibrations and without impairing the functionality of the centrifuge.

If the centrifuge is operated at a small throughput that is below the maximum rate, then the throttling of each individual partial inlet duct that is provided according to the invention will counteract the generation of vibrations. Throttling each individual partial inlet duct and arranging the throttle point at the transition between skimmer device and skimmer disk pipe offers the advantage that the liquid vibrations that might already exist in the area of the skimmer disk are counteracted.

In addition, using throttle elements in the partial inlet ducts prevents liquid in the area of the respective mouth of a partial inlet duct from flowing back into one of the adjacent partial inlet ducts via the shaft duct and in this manner excitation of liquid vibrations.

Furthermore, it is advantageous that with the design of the inlet ducts according to the invention the essentially known possibility of increasing the withdrawal rate by arranging several inlet ducts in the skimmer disk radially offset to one another by a certain angle remains intact. In this manner, subject to the invention, a large number of partial inlet ducts can be arranged such that each of them has a low duct height, which counteracts the generation of liquid vibrations.

The partial inlet ducts can be arranged axially parallel above one another, i.e., they appear congruent in a top view of the skimmer device. This results in a simple design of the skimmer device that differs from conventional ones only in the duct separation elements with the throttle elements that are integrated in the inlet ducts.

Advantageous is also another embodiment, where the partial inlet ducts are arranged offset to one another by an angle.

This optimizes the flows; in particular, it is possible to achieve a directed flow in the area of the mouths of the partial inlet ducts into the shaft duct. The liquid flow of each individual partial inlet duct can thus each form one flow string in a partial area of the circumference of the shaft duct, whereby the flow strings are then adjacent to one another at the circumference of the shaft duct, without causing turbulences in each other.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
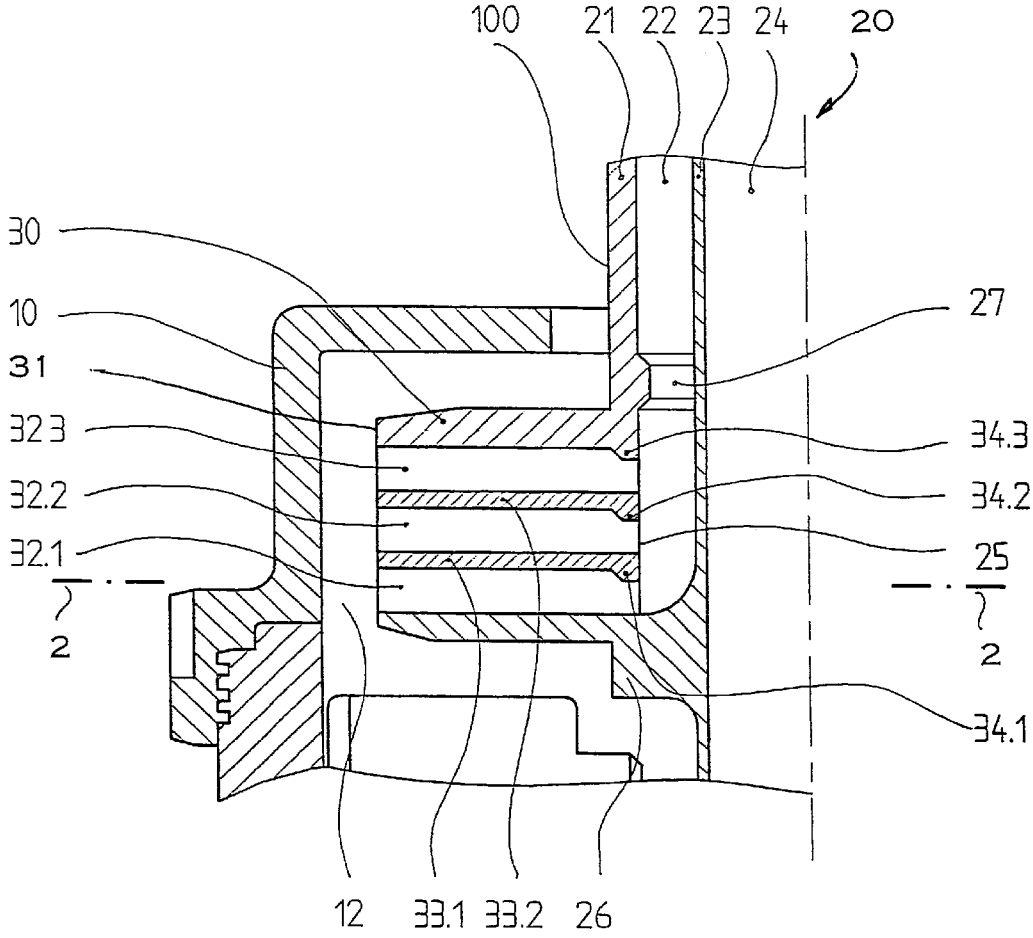
FIG. 1 shows a sectional view of a detail of a skimmer device according to the invention.

The preferred embodiments of the present invention will now be described with reference to FIGS. 1–4 of the drawings. Identical elements in the figures are designated with the same reference numerals.

FIG. 1 shows a section of a skimmer device 100, which is arranged centrically in a centrifuge drum 10. The skimmer device 100 comprises essentially a skimmer disk pipe 20 and a skimmer disk 30 connected at a right angle to it.

In the embodiment shown, the skimmer disc pipe 20 comprises an inlet pipe 24 located on the inside, which is enclosed by an inside pipe wall 23 and through which the liquid can be supplied to the centrifuge drum 10, and a shaft duct 22, which extends between the inside pipe wall 23 and an outside pipe wall 21 of the skimmer disk 30.

By rotating the centrifuge drum 10, a liquid phase that has been separated in the centrifuge is transported to the circular ring space 12 between the skimmer disk 30 and the wall of the centrifuge drum 10. Thus, during the operation of the centrifuge, a rotating liquid ring is present in the circular ring space and is pressed into the partial inlet ducts 32.1 . . . 32.3 of the stationary skimmer disk 30 and is withdrawn from the centrifuge 10 via shaft duct 22 of the skimmer disk pipe 20.

Figure 2:
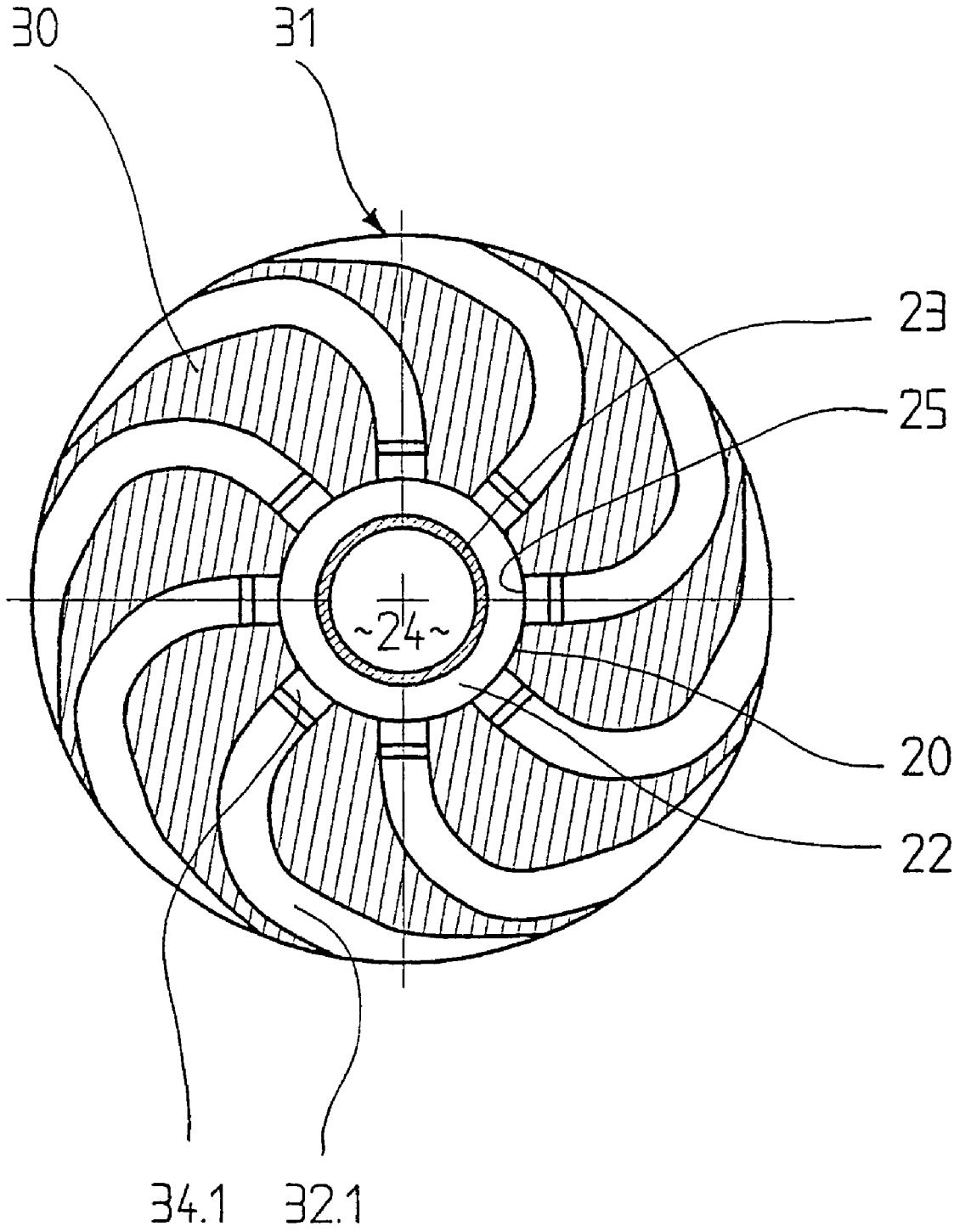
FIG. 2 shows a sectional view of skimmer disk along line 2—2 of FIG. 1.

As in particular FIG. 2 shows, the skimmer disk 30 exhibits a number of partial inside inlet ducts 32.1, which each extend from the periphery 31 of the skimmer disk 30 to a mouth 25, where the inlet ducts 32.1 empty into the shaft duct 22 of the skimmer disk pipe 20. The inlet ducts 32.1, or more specifically all the partial inlet ducts 32.1 . . . 32.3, can be curved parabolically. In the sectional view of FIG. 1, the curved partial inlet ducts 32.1 . . . 32.3 are shown in a simplified manner, namely through a section along their respective center axes.

According to the invention, it is provided, as is again shown in FIG. 1, that each individual inlet duct is split into partial inlet ducts 32.1 . . . 32.3, located above one another, through horizontally arranged duct separating elements 33.1, 33.2 and all empty in the area of the mouth 25 into the common shaft duct 22. For example, an individual inlet shaft 32 with a duct height of 12 mm may be split into three partial inlet ducts 32.1 . . . 32.3 each with a height of 4 mm.

A throttle point is located in the area of the mouth 25. There, each of the partial inlet ducts 32.1 . . . 32.3 exhibits a narrowing of the cross-section, each being caused by a throttle element 34.1 . . . 34.3 in the partial inlet duct. By this, the height of each of the partial inlet ducts 32.1 . . . 32.3 is reduced by 10 to 50%. In particular, with a height restriction range of 20% to 30%, on the one hand, an effective counteraction to the vibration generation is achieved while, on the other hand, an essentially large opening for achieving a high flow rate is provided.

The duct partition elements 33.1, 33.2 are preferably each formed in one piece with a molded-on throttle element 34.1 . . . 34.3 for the partial inlet ducts.

To allow for an adjustment of the throttle effect by changing the throttles, it can be provided also to have separate throttle elements for the partial inlet ducts that are connected to the duct partition elements 33.1, 33.2 in a detachable manner.

In addition, one or more throttle points 27 may also be provided in the shaft duct 22 in order to counteract the generation of vibrations in the head of liquid inside the shaft duct 22.

For each of the partial inlet ducts 32.1 . . . 32.3, the cross-section is preferably selected such that, in the respective inlet area—that is, outside the restriction through the throttle elements 34.1 . . . 34.3 in the partial inlet ducts—the height of the partial inlet duct is greater than its width. Good experience has been achieved with partial inlet channels where the height was less than 80% of the width.

Figure 4:
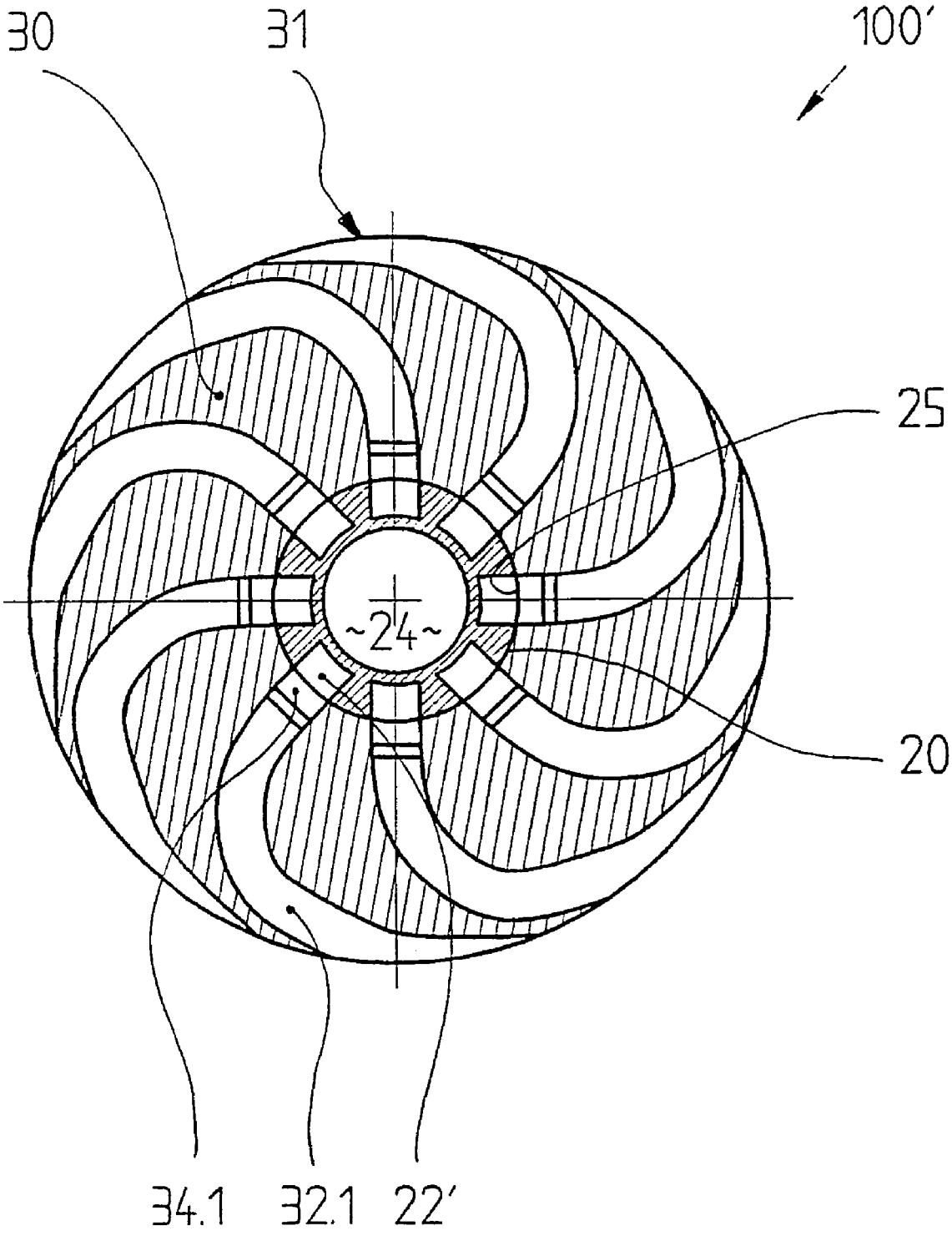
FIG. 4 shows a sectional view of another embodiment of the skimmer disk along line 2—2 of FIG. 1.

FIG. 4 presents another embodiment of a skimmer device 100', where either each individual partial inlet duct 32.1 . . . 32.3 at the mouth 25 changes to a separate individual shaft duct 22', or a packet of partial inlet ducts 32.1 . . . 32.3 that are arranged above one another empties into an individual shaft duct 22'. The single shaft ducts 22' are then combined above the skimmer disk 30, for example at the end of the skimmer disk shaft 20. By splitting the shaft duct into individual shaft ducts 22', flow paths are created that do not influence each other. Even more than with the design of flow strings described above through partial inlet ducts that are offset from one another by an angle, this mechanical separation of the flow paths counteracts turbulences and in so doing, also a reduction of the flow rate.

Figure 3:
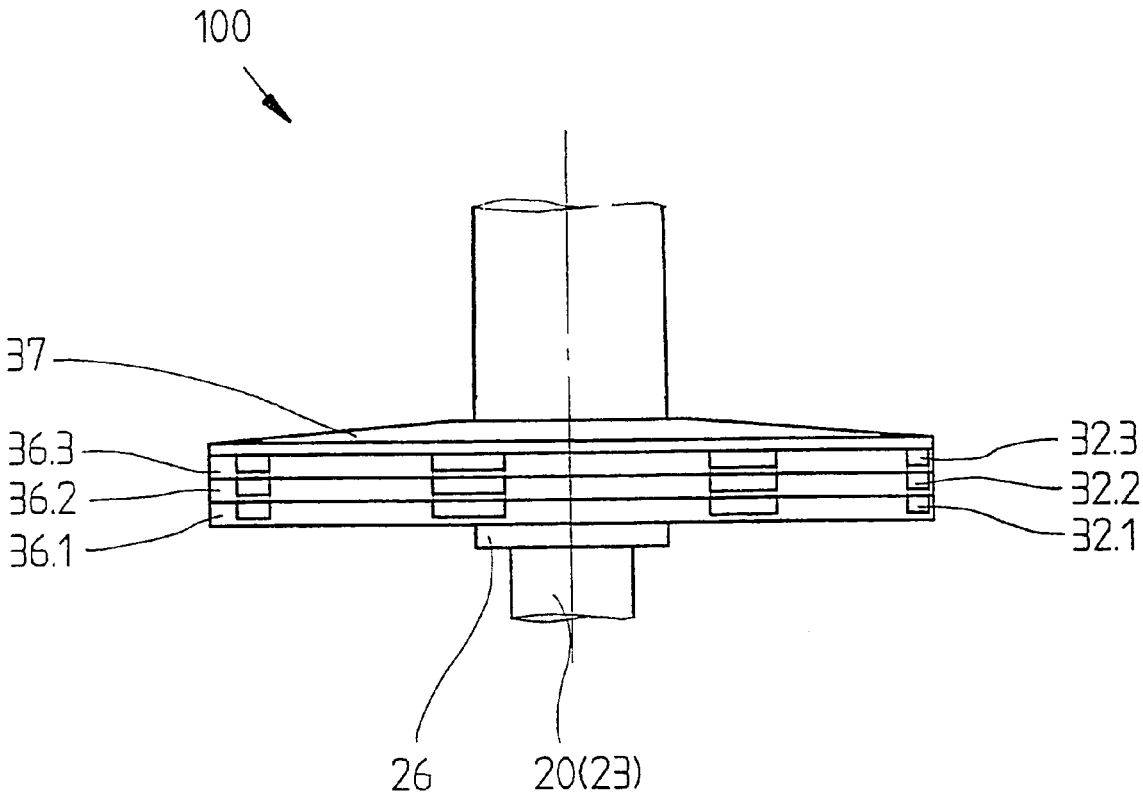
FIG. 3 shows a side view of the skimmer device of FIG. 1.

FIG. 3 presents the skimmer device 100 again outside of a centrifuge drum. This skimmer disk 30 may be made up of several partial disks 36.1 . . . 36.3. Each individual partial disk is provided with one or more partial inlet ducts 32.1 . . . 32.3 that are adjacent to one another. The partial disks 36.1 . . . 36.3 are stacked above one another and conclude with a cover disk 37 located on top. The entire packet of partial disks 36.1 . . . 36.3 is placed on a base 26 at the skimmer disk pipe 20 and clamped through the outer pipe wall 21 of the skimmer disk pipe 20. This enables a modular structure of the skimmer disk 30, allowing adaptation to various products that the centrifuge 10 is to process, and simple manufacturing of the partial inlet ducts 32.1 . . . 32.3. Depending upon the expected volume stream, a more or less large number of radially arranged inlet ducts can be provided at the partial disks 36.1 . . . 36.3 in each plane. Furthermore, to adjust the performance of the skimmer device to the volume stream, the number of partial disks 36.1 . . . 36.3, and thus the number of partial inlet ducts 32.1 . . . 32.3 located above one another, can be changed.

Clamping of the cover disk 37 has the additional advantage over conventional welded connections that a deformation of the inlet ducts 32 and/or embrittlement of the material through too much heat infusion is avoided. Manufacturing and assembly times are reduced as well.

There has thus been shown and described a novel skimmer device for discharging liquid from a centrifuge drum which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. In a skimmer device for discharging liquid from a centrifuge drum, comprising a vertically arranged skimmer disc pipe and a skimmer disc, which is arranged inside the centrifuge drum and is provided with at least one inlet duct that extends from the periphery of the skimmer disc and empties into at least one shaft duct, which extends at least partially along the skimmer disc pipe, whereby the inlet duct and the shaft duct form a discharge duct having at least one throttle point where the cross-sectional area of the discharge duct is reduced, the improvement wherein, the inlet duct is divided into at least two partial inlet ducts that are located one above the other through horizontally arranged duct separating elements and that all empty into the common shaft duct, and wherein each partial inlet duct is provided with at least one throttle element in the partial inlet duct at a throttle point.

2. A skimmer device as set forth in claim 1, wherein the throttle elements in the partial inlet ducts are arranged at the mouth of the partial inlet ducts of the skimmer disk in the at least one shaft duct of the skimmer disk pipe.

3. A skimmer device as set forth in claim 1, wherein the partial inlet ducts are arranged axially parallel above one another.

4. A skimmer device as set forth in claim 1, wherein the height of the partial inlet ducts is reduced by 10% to 50% at the throttle point by the throttle elements in the individual inlet ducts.

5. A skimmer device as set forth in claim 4, wherein the height of the partial inlet ducts is reduced by 20% to 30% at the throttle point by the throttle elements in the individual inlet ducts.

6. A skimmer device as set forth in claim 1, wherein the duct separating elements are formed in one piece each with a molded-on throttle element in the individual inlet ducts.

7. A skimmer device as set forth in claim 1, wherein each of the partial inlet ducts empties into a separate individual shaft duct, whereby the individual shaft ducts are arranged adjacent to one another at the circumference of the skimmer disk pipe and extend at least across a portion of the length of the skimmer disk pipe.

8. A skimmer device as set forth in claim 1, wherein one group each of partial inlet ducts that are arranged vertically above one another empties into a separate individual shaft duct, whereby the individual shaft ducts are arranged next to one another at the circumference of the skimmer disk pipe and extend at least across a portion of the length of the skimmer disk pipe.

9. A skimmer device as set forth in claim 1, wherein outside the throttle point, the height of each partial inlet duct is smaller than its width.

10. A skimmer device as set forth in claim 9, wherein the height of each partial inlet duct is smaller than 0.8 times its width.

* * * * *